US006322054B1

(12) United States Patent
Wu et al.

(10) Patent No.: US 6,322,054 B1
(45) Date of Patent: Nov. 27, 2001

(54) SPRINKLING APPARATUS FOR COOLING TOWER

(76) Inventors: Chung-Hsing Wu; Kang-Shin Chen; Ching-Chih Yu, all of P.O. Box 55-175, Taichung (TW)

( * ) Notice: Subject to any disclaimer, the term of this patent is extended or adjusted under 35 U.S.C. 154(b) by 0 days.

(21) Appl. No.: 09/528,442

(22) Filed: Mar. 17, 2000

(51) Int. Cl.[7] ..... B01F 3/04

(52) U.S. Cl. ..... 261/59; 261/79.2; 261/115; 96/320

(58) Field of Search ..... 261/20, 40, 53, 261/59, 79.2, 115, 118; 96/320, 321

(56) References Cited

U.S. PATENT DOCUMENTS

| | | | | |
|---|---|---|---|---|
| 981,098 | * | 1/1911 | McCaskell | 261/79.2 |
| 1,543,941 | * | 6/1925 | Mathesius | 261/79.2 |
| 2,413,420 | * | 12/1946 | Stephanoff | 261/79.2 |
| 3,304,695 | * | 2/1967 | Krochta | 261/79.2 |
| 3,495,384 | * | 2/1970 | Alliger | 261/79.2 |
| 3,772,856 | * | 11/1973 | Moran | 96/320 |
| 4,810,268 | * | 3/1989 | Chambers et al. | 261/79.2 |
| 5,547,540 | * | 8/1996 | Ruscheweyh | 261/79.2 |

* cited by examiner

*Primary Examiner*—C. Scott Bushey

(57) ABSTRACT

A sprinkling appartaus for cooling tower includes nozzle groups having water tubes and air tubes through the tower wall and corresponding guiding assemblies wherein both water and air tubes have one ends within and adjacent to tower wall and the other ends pierced through tower wall and throttle valve to communicate with water and air tanks respectively, and one end of water tube is bent to face the air discharged opening of air tube; the air tube is oblique with respect to tower wall for effecting a whirling motion in discharged air; and each guiding assembly includes a baffle plate having an engagement portion, a spindle having one end pivotably secured to baffle plate and the other end secured to tower wall, and an adjustment bolt obliquely pierced through tower wall to urge on engagement portion. Baffle plate is impinged by the discharged high speed, high pressure water and air mixture, and engagement portion and baffle plate pivot about spindle by turning bolt for varying the direction of emitted water and air mixture.

1 Claim, 4 Drawing Sheets

SPRINKLING APPARATUS FOR COOLING TOWER

FIELD OF THE INVENTION

The present invention relates to devices for processing exhaust and more particularly to a sprinkling apparatus for cooling tower in an incinerator for effectively filtering out the noxious particles in the exhaust.

BACKGROUND OF THE INVENTION

Conventionally, a plurality of large particles are contained in the exhaust discharged from incinerators. It is common to process the exhaust to filter out such noxious particles prior to discharging to the air. Also, exhaust may be acid. As such, unprocessed acid exhaust may pollute the air. In view of the foregoing, it is necessary to process the exhaust in order not to pollute the environment.

A conventional exhaust processing apparatus is shown in FIG. 1 comprising a cooling tower 1 and a water filtering means 2 wherein top of cooling tower 1 is in communication with the exhaust pipe of combustion chamber of incinerator, while the bottom thereof is in communication with water filtering means 2. Note that water filtering means 2 is conventional such that a detailed description is omitted.

Cooling tower 1 is dome-shaped with an annular tube 4 provided along the inner surface. Tube 4 has one opening connected to inlet pipe 401 which is turn pierces through the wall of tube 4 to be in communication with an external water tank, thereby delivering water therefrom. A plurality of outlets 402 are provided along the bottom of tube 4 for sprinkling water into mist. Such mist is dispersed in the cooling tower 1, thereby mixing with exhaust particles already dispersed therein. The mixture of water mist and exhaust particle is dropped on water filtering means 2 for filtering.

Above apparatus is implemented by the fact that the diameter of outlet 402 is smaller than that of inlet pipe 401 such that flow will sprinkle in high speed and high pressure through outlets 402. It is understood that the higher the pressure the easier the water mist will be mixed with the exhaust particle. As such, the only way to carry out an easier water mist and exhaust particle mixing is to increase water pressure because the diameter of outlet 402 is fixed after installed. However, tube 4 has a pressure limit and thus it is impossible to increase water pressure arbitrarily. Also, water only sprinkles downward after leaving outlets 402. As such, water mist only stays a short time in cooling tower 1, i.e., the time required to travel from outlet 402 to bottom of cooling tower. As a result, the degree of water mist mixed with exhaust particle is poor.

Thus, it is desirable to provide a novel sprinkling apparatus for cooling tower in incinerator in order to overcome the above drawbacks of prior art.

SUMMARY OF THE INVENTION

It is an object of the present invention to provide a sprinkling apparatus for cooling tower in incinerator wherein discharged air impinges on discharged water to enhance the mixing degree of water mist and exhaust particle and baffle plate is pivotable so as to change the direction of water emitting in cooling tower, thereby generating a rapid, violent, whirling motion in water mist and extending the time of water mist staying in cooling tower. This achieves a high degree mixing of water mist and exhaust particle, thus greatly improving the efficiency of filtering out noxious particles in the exhaust.

To achieve the above and other objects, the present invention provides a sprinkling apparatus for cooling tower comprising a plurality of generally equally spaced apart nozzle groups along the periphery of cooling tower and a plurality of guiding assemblies corresponding to nozzle groups wherein each nozzle group is disposed through the wall of cooling tower includes a water tube and an air tube. One end of water tube is within and adjacent to the wall of cooling tower, while the other end thereof is pierced through the wall of cooling tower and throttle valve to be in communication with an external water tank wherein the internal end of water tube is bent to have its opening facing the air discharged opening of air tube so as to cause discharged water to impinge on discharged air to increase the mist degree of water. One end of air tube is within and adjacent to the wall of cooling tower, while the other end thereof is pierced through the wall of cooling tower and throttle valve to be in communication with an external air tank wherein the air tube is oblique at a predetermined angle with respect to the wall of cooling tower so as to effect a whirling motion in discharged air. Each of guiding assemblies includes a rectangular baffle plate having an engagement portion at one end, a spindle having one end pivotably secured to one side of baffle plate and the other end secured to the wall of cooling tower, and an adjustment bolt having a head disposed above the external surface of cooling tower and a threaded rod obliquely pierced through the wall of cooling tower with distal end urged on the engagement portion wherein baffle plate is adjacent and corresponding to the discharged opening of air tube so as to be impinged by the discharged high speed, high pressure water mist, and engagement portion may pivot about the spindle by turning the adjustment bolt so as to actuate baffle plate to clockwise/counterclockwise rotate for varying the direction of water mist emitted in cooling tower.

The above and other objects, features and advantages of the present invention will become apparent from the following detailed description taken with the accompanying drawings.

DETAILED DESCRIPTION OF THE PREFERRED EMBODIMENTS

Figure 1:
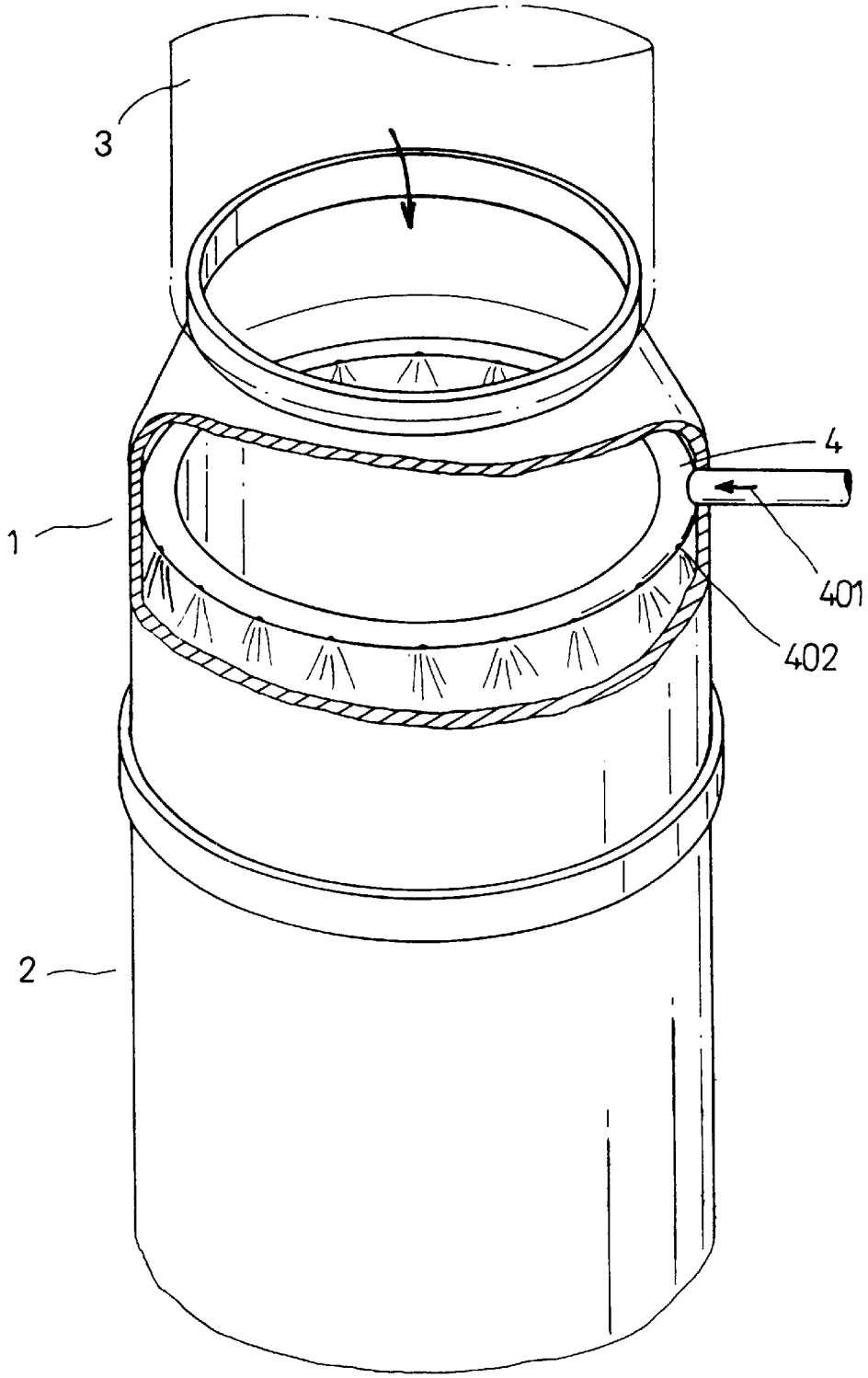
FIG. 1 PRIOR ART
FIG. 1 is a perspective view of conventional exhaust processing apparatus in part section.
Figure 2:
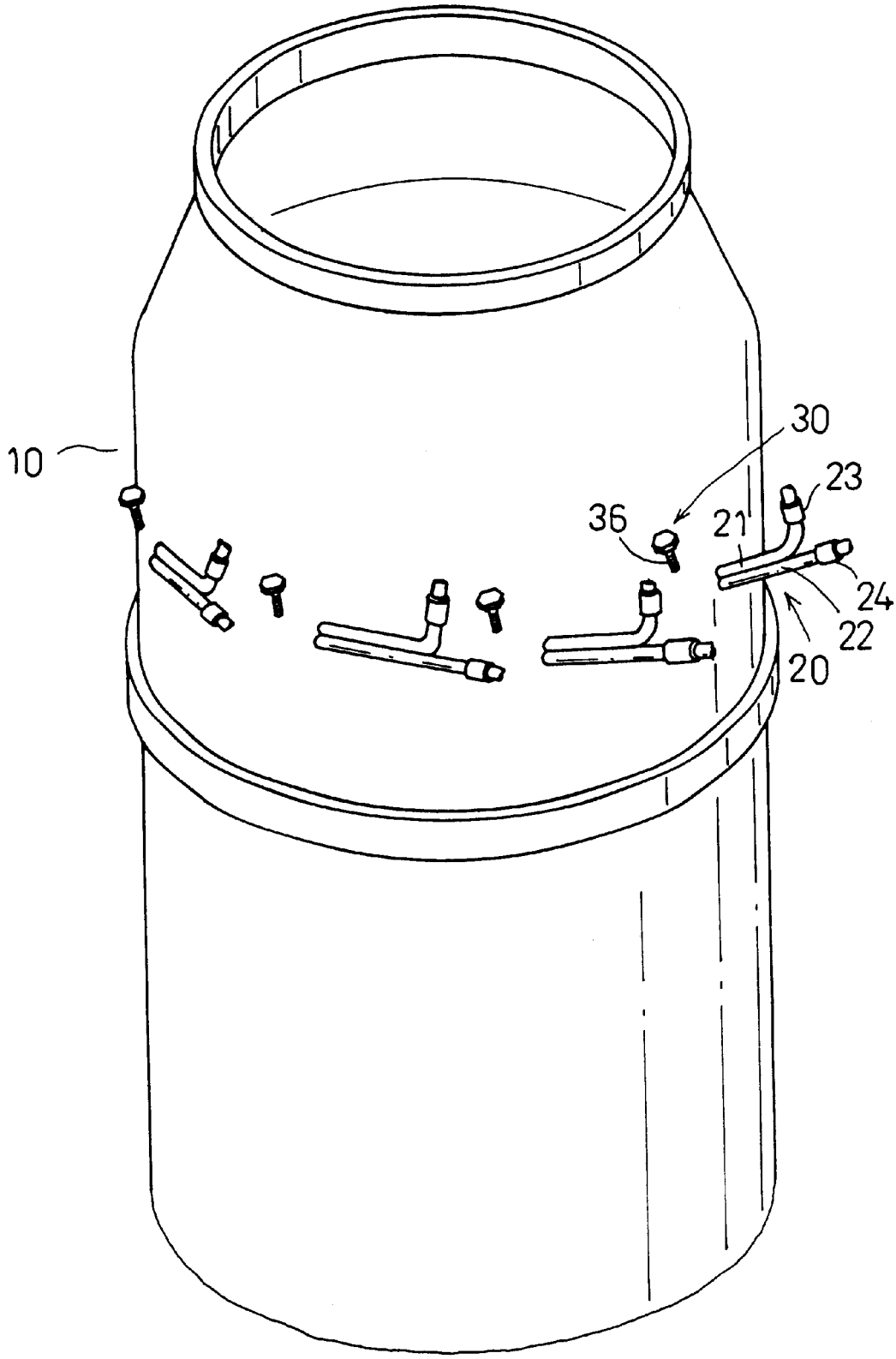
FIG. 2 is a perspective view of a preferred embodiment of exhaust processing apparatus according to the invention.
Figure 3:
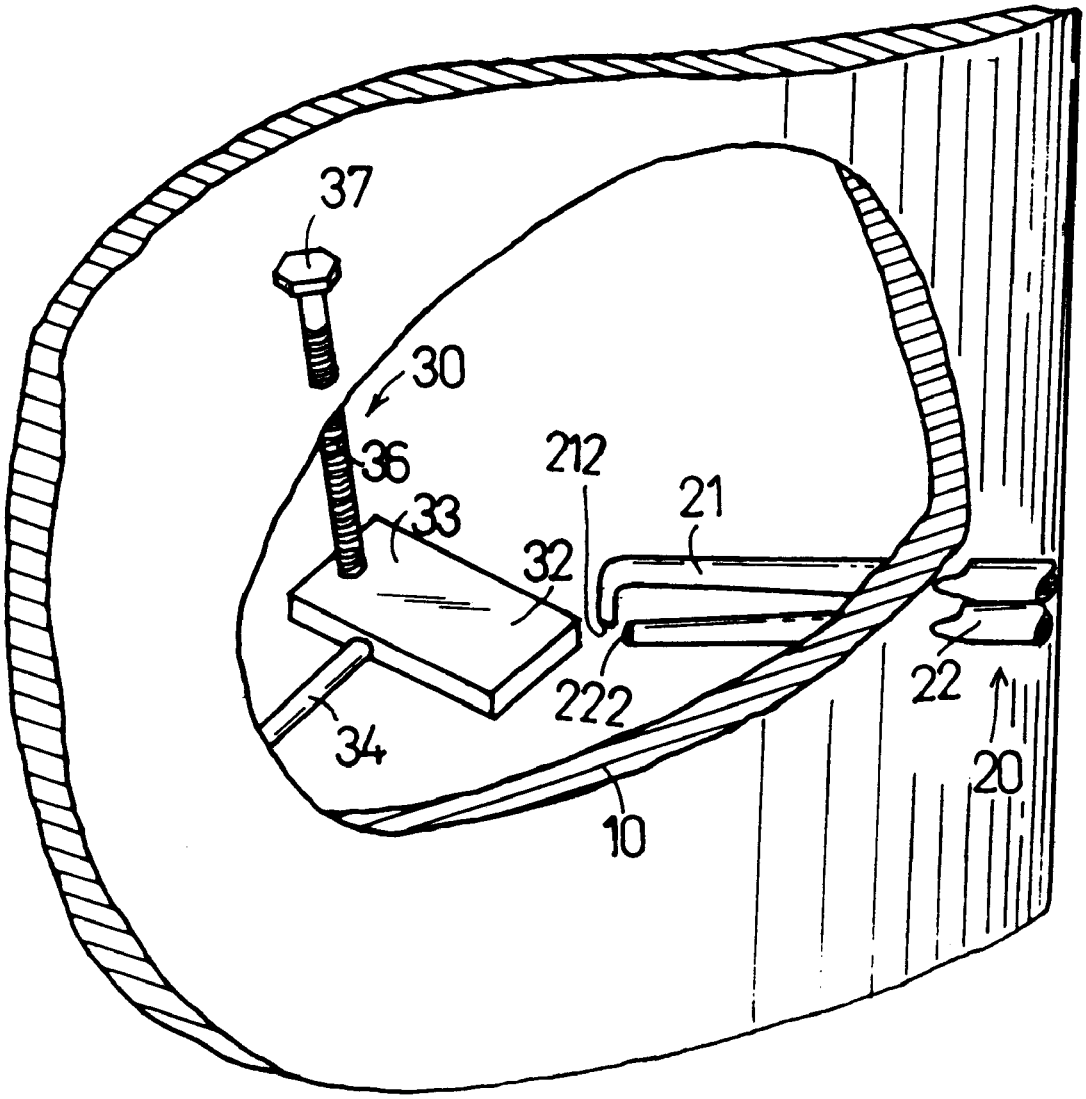
FIG. 3 is a partial view of FIG. 2 with a portion of wall of cooling tower removed to reveal interior features of the invention.

Referring to FIGS. 2 and 3, there is shown a exhaust processing apparatus constructed in accordance with the invention comprising a plurality of generally equally spaced apart nozzle groups 20 along the periphery of cooling tower 10 and a plurality of guiding assemblies 30 corresponding to nozzle groups 20 wherein each nozzle group 20 is disposed through the wall of cooling tower 10 includes a water tube 21 and an air tube 22 each wrapped around by a temperature keeping layer (not shown). One end of water tube 21 is within and adjacent to the wall of cooling tower 10, while the other end thereof is pierced through the wall of cooling tower 10 and throttle valve 23 to be in communication with an external water tank (not shown) wherein the internal end of water tube 21 is bent to have its opening 212 facing the air discharged opening 222 of air tube 22 so as to cause discharged water to impinge on discharged air to increase the mist degree of water. One end of air tube 22 is within and adjacent to the wall of cooling tower 10, while the other end thereof is pierced through the wall of cooling tower 10 and throttle valve 24 to be in communication with an external air tank (not shown) wherein the air tube 22 is oblique at a predetermined angle with respect to the wall of cooling tower 10 so as to effect a whirling motion in discharged air.

Each of guiding assemblies 30 includes a rectangular baffle plate 32 having an engagement portion 33 at one end, a spindle 34 having one end pivotably secured to one side of baffle plate 32 and the other end secured to the wall of cooling tower 10, and an adjustment bolt 36 having a head 37 disposed above the external surface of cooling tower 10 and a threaded rod obliquely pierced through the wall of cooling tower 10 with distal end urged on the engagement portion 33 wherein baffle plate 32 is adjacent and corresponding to the discharged opening 222 of air tube 22 so as to be impinged by the discharged high speed, high pressure water mist, and engagement portion 33 may pivot about the spindle 34 by turning the adjustment bolt 36 so as to actuate baffle plate 32 to clockwise/counterclockwise rotate for varying the direction of water mist emitted in cooling tower 10.

Figure 4:
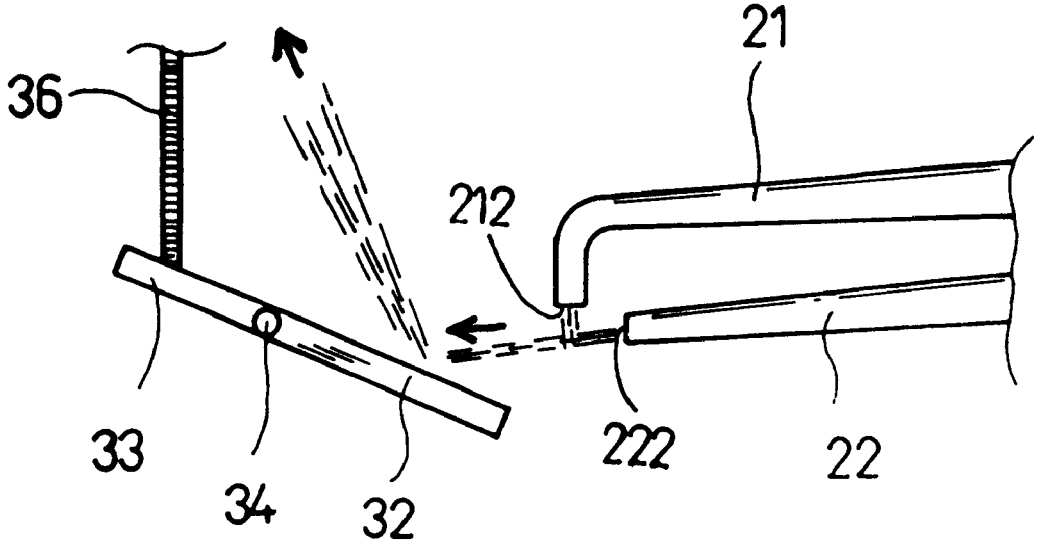
FIG. 4 is side view illustrating the water and air discharging process of the invention.

FIG. 4 illustrates a water and air discharging process of the invention. As shown, the flow and pressure of air and water can be controlled by valves 24 and 23 respectively. Further, water leaving bent opening 212 of water tube 21 may impinge on opening 222 of air tube 22 for increasing the mist degree of water. Also, a whirling motion in discharged air may be effected since air tube 22 is oblique with respect to the wall of cooling tower 10 so as to prolong the staying time of water mist for more uniformly dispersed in the tower 10. This achieves a high degree mixing of water mist and exhaust particle. Moreover, the prolonging of water mist stayed in tower 10 may be effected by turning bolt 36 to cause engagement portion 33 and baffle plate 32 to pivot about spindle 34 for varying the direction of emitted water and air mixture (i.e., upward, downward, or any of other desired angles). Thus the invention can greatly improve the efficiency of filtering out noxious particles in the exhaust.

Moreover, it is possible to add base substances (e.g., sodium hydroxide (NaOH)) in supply water so as to generate a base water solution if exhaust contains acid particles. As such, base water reacts with acid exhaust to neutralize. Thus, a potential air pollution is avoided due to the neutralized exhaust.

Also, the technique of sprinkling apparatus for cooling tower of the invention may be applied in devices such as in the combustion chamber of boiler as long as a complete mixing of liquid and vapor is required.

While the invention herein disclosed has been described by means of specific embodiments, numerous modifications and variations could be made thereto by those skilled in the art without departing from the scope and spirit of the invention set forth in the claims.

What is claimed is:

1. A sprinkling apparatus of a cooling tower of an incinerator comprising:

a plurality of nozzle groups spaced apart along a periphery of the cooling tower including a water tube with a first throttle valve and an air tube with a second throttle valve, each of the nozzle groups being disposed through a wall of the cooling tower; and a plurality of guiding assemblies corresponding to the nozzle groups;

wherein both the water and the air tubes have one end within and adjacent to the wall of the cooling tower and the other end pierced through the wall of the cooling tower and the throttle valves to communicate with an outside, one end of the water tube is bent to have its opening facing an opening of the air tube for impinging discharged water on discharged air to generate a water and air mixture, the air tube is oblique at a predetermined angle with respect to the wall of the cooling tower for causing a whirling motion in discharged air; each of the guiding assemblies includes a baffle plate having an engagement portion at one end, a spindle having one end pivotably secured to one side of the baffle plate and the other end secured to the wall of the cooling tower, an adjustment bolt having a head disposed above an external surface of the cooling tower and a threaded rod obliquely pierced through the wall of the cooling tower with a distal end urged on the engagement portion wherein the baffle plate is adjacent and corresponding to the opening of the air tube so as to be impinged by the water and air mixture, and the engagement portion and the baffle plate pivot about the spindle by turning the adjustment bolt for varying a direction of the emitted water and air mixture.

* * * * *